US006561491B2

(12) United States Patent
Thompson et al.

(10) Patent No.: US 6,561,491 B2
(45) **Date of Patent: *May 13, 2003**

(54) FENCE GUARD

(76) Inventors: Allen R. Thompson, 2442 Didrickson Dr., Lorain, OH (US) 44053; Kimberly Thompson, 2442 Didrickson Dr., Lorain, OH (US) 44053

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/195,439

(22) Filed: Nov. 18, 1998

(65) Prior Publication Data

US 2001/0013594 A1 Aug. 16, 2001

(51) Int. Cl.[7] ..... E04H 17/00
(52) U.S. Cl. ..... 256/1; 256/32; 47/33
(58) Field of Search ..... 256/1, 32, 24, 256/47; 52/102; 47/33

(56) References Cited

U.S. PATENT DOCUMENTS

| | | | | | |
|---|---|---|---|---|---|
| 3,195,863 | A | * | 7/1965 | Korecky et al. | |
| 3,293,812 | A | * | 12/1966 | Hammitt | |
| 3,377,054 | A | * | 4/1968 | Thron | |
| 3,495,352 | A | * | 2/1970 | Sbare | 47/33 |
| 3,713,624 | A | * | 1/1973 | Niemann | 256/32 |
| 3,768,780 | A | * | 10/1973 | Cowles et al. | 256/1 |
| 3,806,096 | A | | 4/1974 | Eccleston et al. | 256/32 |
| 3,945,747 | A | | 3/1976 | Cruz | 404/7 |
| 3,991,980 | A | * | 11/1976 | Blackburn | 256/45 X |
| 4,349,989 | A | | 9/1982 | Snider, Jr. | 47/33 |
| 4,497,472 | A | * | 2/1985 | Johnson | 256/32 |
| 4,515,349 | A | * | 5/1985 | Groves | 256/1 |
| 4,548,388 | A | * | 10/1985 | Cobler | 256/32 |
| 4,595,175 | A | | 6/1986 | Kauffman et al. | 256/1 |
| 4,663,883 | A | * | 5/1987 | Hilliard et al. | 47/33 |
| 4,690,382 | A | * | 9/1987 | Koperdak | 256/1 |
| RE33,037 | E | | 8/1989 | Kauffman et al. | 256/1 |
| D304,086 | S | | 10/1989 | Eads | D8/1 |
| 4,903,947 | A | * | 2/1990 | Groves | 256/32 |
| 4,964,619 | A | * | 10/1990 | Glidden, Jr. | 256/32 |
| 5,035,079 | A | * | 7/1991 | Groves | 256/1 X |
| 5,039,065 | A | * | 8/1991 | Denton | 256/1 |
| 5,178,369 | A | * | 1/1993 | Syx | 256/32 |
| D343,774 | S | | 2/1994 | Cox et al. | D8/1 |
| D352,643 | S | | 11/1994 | Hoculik | D8/1 |
| 5,377,447 | A | * | 1/1995 | Fritch | 47/33 |
| 5,615,866 | A | * | 4/1997 | Kinnison | 256/1 |
| 5,660,374 | A | * | 8/1997 | Dayberry | 256/1 |
| 5,826,372 | A | * | 10/1998 | Parsons | 47/33 |
| 6,070,859 | A | * | 6/2000 | Damon et al. | 256/1 |

FOREIGN PATENT DOCUMENTS

| | | | |
|---|---|---|---|
| DE | 3244618 | * | 6/1984 |
| FR | 1362040 | * | 4/1964 |

* cited by examiner

*Primary Examiner*—Lynne H. Browne
*Assistant Examiner*—John Cottingham
(74) *Attorney, Agent, or Firm*—John D. Gugliotta

(57) ABSTRACT

Disclosed is a covering designed to be attached to and along the bottom portion of chain-linked and other similar types of fencing in order to prevent grass and weeds from growing between the links. Produced in varying lengths from a rubber or plastic type material, the covering has an L-shaped profile that allows it to be placed along the bottom edge of the fencing resting on the ground and against the fence. The mowing strip portion of the L-shape guard that rests upon the ground extends out horizontally from the bottom of the fence serves a shield that will prevent plant growth along the fence line.

5 Claims, 3 Drawing Sheets

FENCE GUARD

BACKGROUND OF THE INVENTION

1. Field of the Invention

The present invention relates generally to chain link fencing, and more specifically to a fence guard that is used to line the lower perimeter of a chain link fence, preventing the growth of grass and weeds therein and providing a decorative border along the fence line.

2. Description of the Related Art

For those who use chain-linked fencing to serve as a property boundary, we know all to well of the difficulties and burdens associated with keeping grass and weeds from growing in between the fence links. The grass and weeds tend to become entangled in the fencing, making it difficult to remove even with conventional gas-powered line trimmers. The metal mesh fencing materials shield the grass and weeds and also tend to sever the trimmer filament line, forcing one to expend an excessive amount of time, effort and materials in order to complete the job. Alternatively, some people use chemical treatments to remove the grass and weeds, however this method is expensive and many people question the environmental effects associated with their use. Accordingly, the need has developed for a means by which one can prevent grass and weeds from growing in between chain-linked fencing and becoming entangled therein. The development of the present invention fencing cover fulfills this need by providing a decorative shield that attaches both to the bottom of the fencing and to the ground, providing a stable and effective shield that prevents the growth of grass and weeds along the fence line.

A search of the prior art did not disclose any patents that read directly on the claims of the instant invention. However, several references to vegetation shields for use with fencing were discovered. These devices neither anticipate nor disclose any embodiment that would preclude the novelty and the utilitarian functionality of the features of the present invention.

Several patents disclose fence guards that are used to prevent growth of grass and weeds along the bottom portion of a chain link fence or the like:

U.S. Pat. No. 4,595,175, issued in the name of Kauffman et al.;

U.S. Pat. No. 4,349,989, issued in the name of Snider Jr.;

U.S. Pat. No. 3,945,747, issued in the name of Cruz;

U.S. Pat. No. 3,806,096, issued in the name of Eccleston et al.;

U.S. Pat. No. Des. 352,643, issued in the name of Hoculik;

U.S. Pat. No. Des. 343,774, issued in the name of Cox et al.;

U.S. Pat. No. Des. 304,086, issued in the name of Eads; and

U.S. Pat. No. RE 33,037, issued in the name of Kauffman et al.

While the intent of these inventions is to prevent the growth of vegetation along the bottom of a chain link fence, these designs suffer from a variety of flaws that make them difficult to install and use. Designed to extend from beneath the fence on both sides from the bottom, installation would require that the guard be slid under the fence, the result being that a great deal of difficulty would be encountered in raising the fencing to the requisite height. These designs also incorporate minimal, if any, anchoring means by which to secure the guard in place on the ground beneath the fence. Many of these designs are unnecessarily complex, having a variety of connectors and special parts that are used to navigate around fence posts and corners that add both to the installation difficulty and to the cost of manufacture. Furthermore, these designs do not disclose any means by which to secure the guard to the fencing itself, creating the likelihood that the guard can shift out of place over time. Finally, many of these disclosures fail to take aesthetic qualities into consideration in the design of the fence guard.

While several features exhibited within these references may be incorporated into this invention, alone and in combination with other elements, the present invention is sufficiently different so as to make it distinguishable over the prior art.

SUMMARY OF THE INVENTION

The present invention consists of a covering designed to be attached to and along the bottom portion of chain-linked and other similar types of fencing in order to prevent grass and weeds from growing between the links. Produced in varying lengths from a rubber or plastic type material, the covering has an L-shaped profile that allows it to be placed along the bottom edge of the fencing resting on the ground and against the fence. The mowing strip portion of the L-shape guard that rests upon the ground extends out horizontally from the bottom of the fence serves a shield that will prevent plant growth along the fence line. The user simply cuts the guard to the appropriate length and places it along the fence line, spiking it into the ground with spikes and securing it to the fencing. Installed in place, the present invention prevents grass and weeds from growing between the fencing links and along the sides thereof, allowing the user to mow all of the grass adjacent to the fence with a lawn mower, alone, and eliminating the need to trim along the fence. Furthermore, use of the cover can help prevent injuries to people and pets associated with these types of fencing that occur often when feet slide under or become entangled therein. The material construction of the covering is of a rugged, durable quality designed to withstand years of use. Available in a variety of styles and colors, the present invention serves as a time-saving yard maintenance tool while adding aesthetic beauty to one's yard.

It is therefore an object of the present invention to provide a fence guard that prevents unwanted growth of grass and weeds along a fence line.

It is another object of the present invention to provide a fence guard that minimizes the need to trim grass and weeds along a fence line, allowing the use of a lawnmower to trim the area adjacent to the fencing.

It is another object of the present invention to provide a fence guard that can be used along a single side or both sides of a fence line.

It is another object of the present invention to provide a fence guard that attaches both to the fencing and to the ground along which it lies, thus improving the stability of the fencing and the fence guard.

It is another object of the present invention to provide a fence guard that attaches to a single side of the fencing, allowing the user to selectably use the guard on one side or both sides of a fence line.

It is another object of the present invention to provide a fence guard that enhances the aesthetic beauty of the fence line to which it is attached.

It is another object of the present invention to provide a fence guard that is of a single-piece construction that does not require the use of a variety of component pieces to navigate the corners and fence posts encountered while navigating a fence line.

It is another object of the present invention to provide a fence guard that is constructed of a strong, durable and flexible material that allows it to be closely molded along a fence line.

Finally, it is an object of the present invention to provide a fence guard that uses readily available materials and manufacturing methods, resulting in a cost-effective production.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
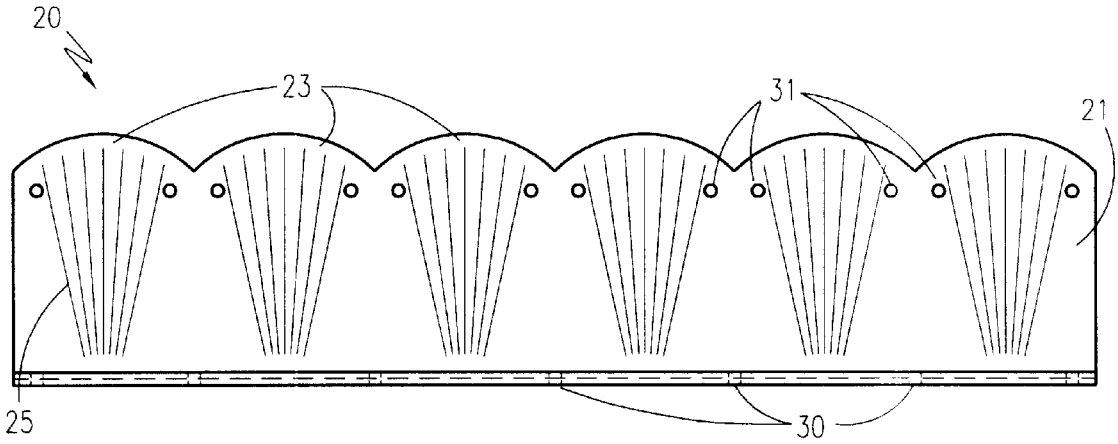
FIG. 1 is a front view of the fence guard, according to the preferred embodiment of the present invention.
Figure 2:
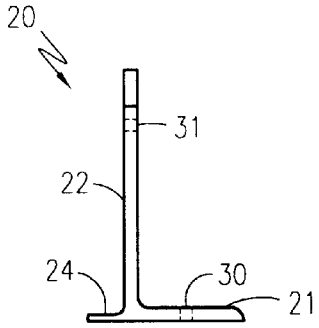
FIG. 2 is a left end view of the fence guard, according to the preferred embodiment of the present invention.
Figure 3:
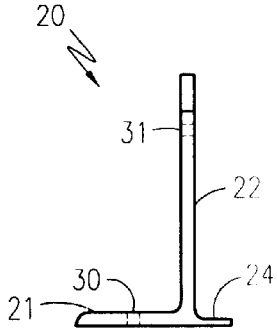
FIG. 3 is a right end view of the fence guard, according to the preferred embodiment of the present invention.
Figure 4:
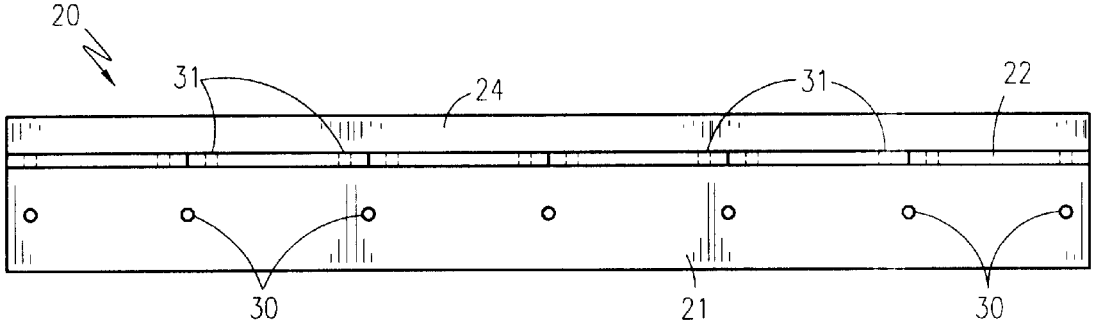
FIG. 4 is a top view of the fence guard, according to the preferred embodiment of the present invention.
Figure 5:
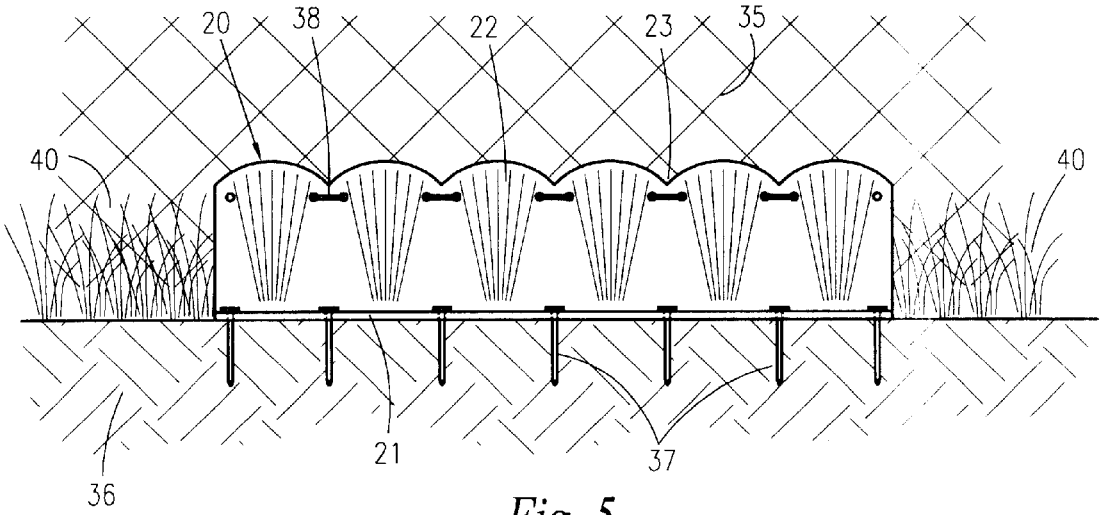
FIG. 5 is a front elevation view of the fence guard, depicting its installation along a length of chain link fencing, according to the preferred embodiment of the present invention.
Figure 6:
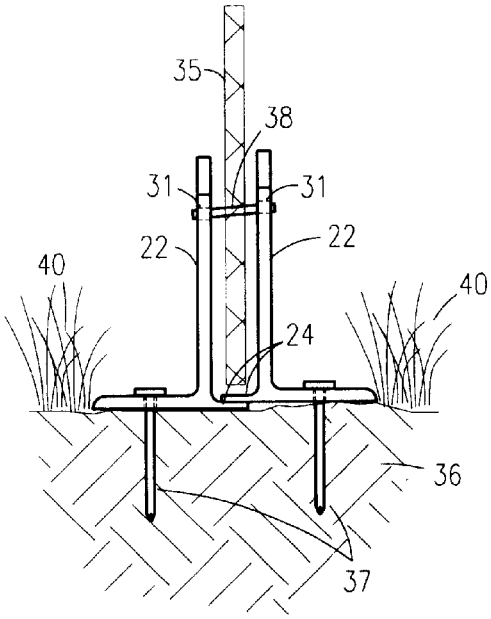
FIG. 6 is an end front elevation view of the fence guard, depicting its installation along a length of chain link fencing, according to the preferred embodiment of the present invention.
Figure 7:
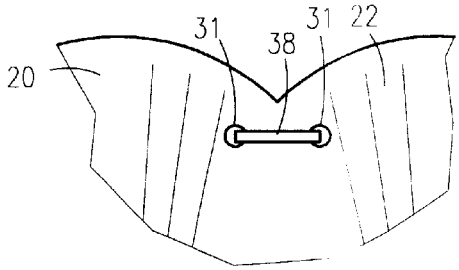
FIG. 7 is a magnified front view of the fence guard, depicting its attachment to a chain link fence, according to the preferred embodiment of the present invention.
Figure 8:
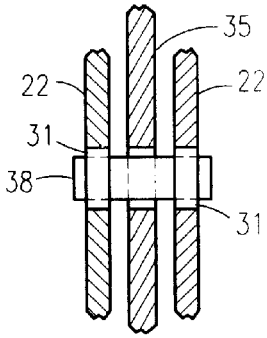
FIG. 8 is a magnified side view of the fence guard, depicting its attachment to a chain link fence according to the preferred embodiment of the present invention.

| LIST OF REFERENCE NUMBERS | |
|---|---|
| 20 | Fence Guard |
| 21 | Growth Shield Portion |
| 22 | Fence Shield Portion |
| 23 | Arcuate Ridges |
| 24 | Overlap Strip |
| 30 | Spike Apertures |
| 31 | Fence Securing Apertures |
| 35 | Fence |
| 36 | Ground |
| 37 | Spikes |
| 38 | Fastener |
| 40 | Grass And Weeds |
| 41 | Corner |
| 42 | Fence Post |

DESCRIPTION OF THE PREFERRED EMBODIMENTS

1. Detailed Description of the Figures

Referring now to FIGS. 1–4, depicted is a fence guard 20, according to the preferred embodiment of the present invention. The fence guard 20 is generally elongated and has an L-shaped cross-section defining a horizontal growth shield portion 21 having a generally perpendicular orientation with a vertical fence shield portion 22. The fence shield portion 22 incorporates an aesthetic design in which various colors, textures and styles can be incorporated in order to suit the taste of the user. For display purposes, the fence shield portion 22 is depicted as having a series of arcuate ridges 23 along its upper edge. An overlap strip 24 runs the length of the fence guard 20 and extends from the point of intersection between the growth shield portion 21 and the fence shield portion 22 in a direction in linear alignment with the growth shield portion 21. A series of spike apertures 30 spaced along the growth shield portion 21 and a series of fence securing apertures 31 spaced along the fence shield portion 22 allow the fence guard 20 to be secured to both the fence and the ground along which it is installed. The fence securing apertures 31 are arranged in pairs along the fence shield portion 22.

Referring now to FIGS. 5–8, the fence guard 20 is depicted in its use as a shield preventing the growth of grass and weeds along a fence line, according to the preferred embodiment of the present invention. The fence guard 20 is positioned along a fence 35, oriented so that the fence shield portion 22 lies against the fence 35, the growth shield portion 21 lies adjacent to the ground 36 and the overlap strip 24 extends beneath the fence 35. A series of spikes 37 are driven into the ground 36 through the spike apertures 30, securing the growth shield portion 21 of the fence guard 20 to the ground 36. The fence securing apertures 31 allow the fence shield portion 22 of the fence guard 20 to be secured to the structure of the fence 35, typically of a chain link design, by a fastener 38. The fastener 38 can be selected from a variety of available designs such as wire-twist fasteners and plastic tooth and groove slip-on fasteners (not shown). Positioned as such, the fence guard 20 prevents the growth of grass and weeds 40 along the fence line. The spikes 37 in combination with the fasteners 38 help stabilize the fence 35 by anchoring it to the ground 36.

The fence guard 20 is depicted as being installed in pairs, on both sides of the fence 35 so as to prevent the growth of grass and weeds 40 along its length and on both sides. In doing so, the overlap strips 24 engage with one another in an overlapping fashion, thus producing a solid barrier beneath the fence 35 so as to prevent grass and weeds 40 from growing therein between. The dimensions of the overlap strips 24 are designed so as to coincide with the average thickness of conventional chain link fencing so as to provide a close tolerance fit therewith. Arranged in this fashion, the fence securing apertures 31 of the fence guard 20 pair are aligned with one another so that a single fastener 38 can be used to secure both to the fence 35.

2. Operation of the Preferred Embodiment

Figure 9:
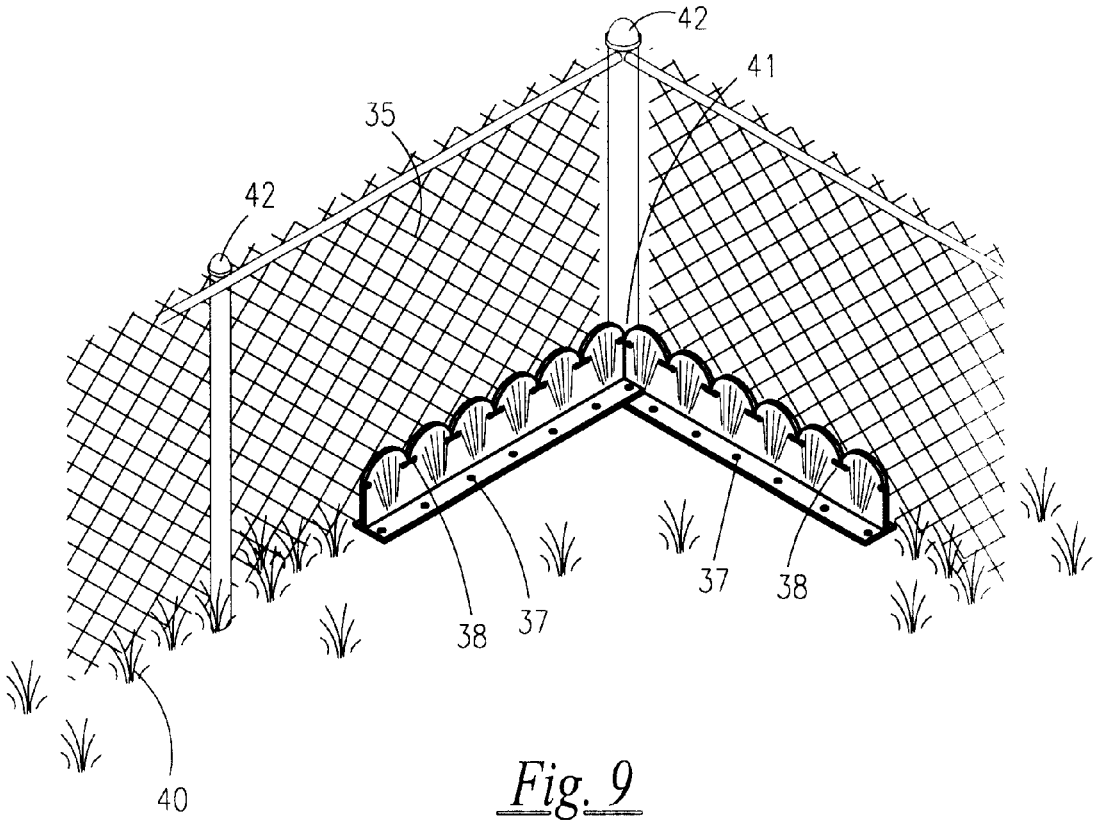
FIG. 9 is a perspective view of the fence guard, depicting its use in combination with a chain link fence, according to the preferred embodiment of the present invention.

In accordance with the preferred embodiment of the present invention and as shown in FIG. 9, the fence guard 20 is installed along the bottom portion of a length of fence 35 in order to prevent the growth of grass and weeds 40 therealong. The fence guard 20 is installed using the spikes 37 and fasteners 38 to attach it to both the ground 36 and the fence 35, respectively. In the instance where a corner 41 is encountered, the installer can install separate lengths of the fence guard 20 in an abutting manner, cutting the overlap strips 24 so as to conform with and accept the fence post 42 typically encountered at a corner 41 in the fencing. Alternatively, the corner 41 can be navigated by cutting into both the overlap strip 24 and the growth shielding portion 22 in a direction perpendicular to the longitudinal axis of the fence guard 20 and to a depth meeting with the fence shielding portion 21. The cuts in the growth shielding portion 22 and the overlap strip 24 allow the fence guard 20 to be bent, forming a vertical crease in the fence shielding portion 21 that coincides with the corner 41. In the instance where a fence post 42 is encountered, the user can cut the overlap strips 24 so as to conform with and accept the fence post 42. Installed as such, the fence guard 20 prevents grass and weeds 40 from growing along the fence 35, stabilizes the bottom of the fence 35 and provides and aesthetically pleasing border.

While the preferred embodiments of the invention have been shown, illustrated, and described, it will be apparent to those skilled in this field that various modifications may be made in these embodiments without departing from the spirit of the present invention. It is for this reason that the scope of the invention is set forth in and is to be limited only by the following claims.

What is claimed is:

1. A fence guard for preventing the growth of vegetation along a fence line, providing stabilization of a lower portion of said fence line and providing an aesthetically pleasing fence border, said fence guard comprising:

a linearly elongated fence border having a generally L-shaped cross-section defining a horizontal growth shielding portion oriented perpendicular to a vertical fence shielding portion, said growth shielding portion having an upper surface opposite a ground engaging surface and said fence shielding portion having an outer surface opposite a fence engaging surface;

a series of spike apertures spaced along said growth shielding portion, said spike apertures providing fluid communication between said upper surface and said ground engaging surface of said growth shielding portion;

a series of fence securing apertures spaced along said fence shielding portion, said fence securing apertures arranged in pairs and providing fluid communication between said outer surface and said fence engaging surface of said fence shielding portion; and an overlap strip formed opposite said growth shielding portion and extending in a direction perpendicular from said fence shielding portion, said overlap strip extending the entire length of said fence guard.

2. The fence guard of claim 1 wherein spike means driven through said spike aperture is adapted to secure said fence guard to the ground and strapping means passing through said fence securing apertures is adapted to secure said fence guard to a fence, said fence guard positioned along the intersection of the fence and the ground.

3. The fence guard of claim 1 wherein said overlap strip is adapted to extend beneath a fence.

4. The fence guard of claim 1 wherein said ground engaging surface in combination with said overlap strip creates a barrier with the ground that prevents the growth of vegetation therefrom.

5. The fence guard of claim 1 wherein said fence guard is depicted as being installed in pairs, wherein said pairs include a first fence guard located on a side of a fence opposite a second fence guard, said overlap strip of said first fence guard overlapping said overlap strip of said second fence guard, wherein said overlap strip of said first fence guard and said overlap strip of said second fence guard overlapping one another beneath the fence, said ground engaging surfaces and said overlapping strips of said first fence guard and said second fence guard creating a contiguous barrier with the ground that prevents growth of vegetation therefrom.

* * * * *